US010078297B2

(12) United States Patent
Imaizumi et al.

(10) Patent No.: US 10,078,297 B2
(45) Date of Patent: Sep. 18, 2018

(54) IMAGE FORMING APPARATUS

(71) Applicant: CANON KABUSHIKI KAISHA, Tokyo (JP)

(72) Inventors: Toru Imaizumi, Kawasaki (JP); Takashi Narahara, Mishima (JP); Yasuhito Minamishima, Odawara (JP); Kenichi Ogawa, Kawasaki (JP); Masaru Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/938,249

(22) Filed: Nov. 11, 2015

(65) Prior Publication Data

US 2016/0139546 A1 May 19, 2016

(30) Foreign Application Priority Data

Nov. 13, 2014 (JP) ..... 2014-230495

(51) Int. Cl.
*G03G 15/20* (2006.01)
*G03G 21/20* (2006.01)

(52) U.S. Cl.
CPC ..... *G03G 15/2017* (2013.01); *G03G 21/203* (2013.01); *G03G 2215/2035* (2013.01)

(58) Field of Classification Search
CPC ..... G03G 15/2017; G03G 21/1619; G03G 21/1685; G03G 21/203; G03G 2221/1639
(Continued)

(56) References Cited

U.S. PATENT DOCUMENTS 3,981,269 A * 9/1976 Watahiki ..... G03G 15/2025 118/60
4,027,967 A * 6/1977 Euler ..... G03G 15/75 310/253

(Continued)

FOREIGN PATENT DOCUMENTS

JP 54127333 A * 10/1979 ..... G03G 15/20
JP H06-163146 A 6/1994

(Continued)

OTHER PUBLICATIONS

U.S. Appl. No. 14/955,334, filed Dec. 1, 2015.
U.S. Appl. No. 14/833,445, filed Aug. 24, 2015.
U.S. Appl. No. 14/938,236, filed Nov. 11, 2015.

*Primary Examiner* — Benjamin Schmitt
(74) *Attorney, Agent, or Firm* — Fitzpatrick, Cella, Harper & Scinto

(57) ABSTRACT

An image forming apparatus for forming a toner image on a recording material. The image forming apparatus includes an image forming portion to form the toner image on the recording material, and a fixing portion to fix, at a nip, the toner image on the recording material by feeding and heating the recording material on which the toner image is formed. The fixing portion includes a roller having an outer surface that has electroconductivity, a rotatable member that forms the nip and is in contact with the roller, and a casing having electroconductivity. An electrical insulating member is positioned (i) nearest to the outer surface of the roller, and (ii) between the inner surface of the casing and the outer surface of the roller. The electrical insulating member does not directly or indirectly contact the outer surface of the roller, and is provided with a water-absorbing member.

18 Claims, 7 Drawing Sheets

(58) Field of Classification Search
USPC ..... 399/91, 97
See application file for complete search history.

(56) References Cited

U.S. PATENT DOCUMENTS

| | | | | |
|---|---|---|---|---|
| 4,751,548 | A * | 6/1988 | Lawson | G03G 15/2025 118/260 |
| 5,091,752 | A * | 2/1992 | Okada | G03G 15/2064 399/329 |
| 5,787,319 | A * | 7/1998 | Tomatsu | G03G 15/2039 219/216 |
| 6,049,691 | A * | 4/2000 | Abe | G03G 15/2064 219/619 |
| 6,895,207 | B2 | 5/2005 | Kataoka et al. | |
| 7,389,079 | B2 | 6/2008 | Narahara et al. | |
| 8,301,067 | B2 | 10/2012 | Takada | |
| 8,331,819 | B2 | 12/2012 | Fukuzawa et al. | |
| 8,364,067 | B2 | 1/2013 | Miki et al. | |
| 8,532,530 | B2 | 9/2013 | Nishida et al. | |
| 8,744,296 | B2 | 6/2014 | Fukuzawa et al. | |
| 8,831,493 | B2 | 9/2014 | Tanaka et al. | |
| 8,971,744 | B2 | 3/2015 | Nihonyanagi et al. | |
| 2002/0057919 | A1* | 5/2002 | Tomatsu | G03G 15/2039 399/69 |
| 2002/0190060 | A1* | 12/2002 | Imai | G03G 15/2042 219/619 |
| 2003/0077092 | A1 | 4/2003 | Ogawa et al. | |
| 2004/0037582 | A1* | 2/2004 | Shin | G03G 21/206 399/93 |
| 2004/0120737 | A1* | 6/2004 | Kataoka | G03G 15/2053 399/328 |
| 2005/0013639 | A1* | 1/2005 | Komuro | G03G 15/2057 399/328 |
| 2007/0071515 | A1* | 3/2007 | Jang | G03G 15/2064 399/328 |
| 2009/0297195 | A1* | 12/2009 | Ferencz, Jr. | G03G 15/6573 399/67 |
| 2014/0186078 | A1 | 7/2014 | Imaizumi et al. | |
| 2015/0023704 | A1 | 1/2015 | Imaizumi et al. | |
| 2015/0227091 | A1 | 8/2015 | Ando et al. | |

FOREIGN PATENT DOCUMENTS

| | | | |
|---|---|---|---|
| JP | H11-258944 | A | 9/1999 |
| JP | 2004-170950 | A | 6/2004 |
| JP | 2005-292689 | A | 10/2005 |
| JP | 2006-047556 | A | 2/2006 |
| JP | 2006-330558 | A | 12/2006 |
| JP | 2007-025053 | A | 2/2007 |
| JP | 2007-86509 | A | 4/2007 |
| JP | 2007-156237 | A | 6/2007 |
| JP | 2010-061113 | A | 3/2010 |
| JP | 2012-103433 | A | 5/2012 |

* cited by examiner (a)

(b)

(a)

(b)

(a)

(b)

IMAGE FORMING APPARATUS

FIELD OF THE INVENTION AND RELATED ART

The present invention relates to an image forming apparatus, such as a copying machine, a laser beam printer or a facsimile machine, of an electrophotographic type.

In the image forming apparatus of the electrophotographic type, a developer (toner) image electrically charged as an unfixed image is electrostatically transferred onto a recording material and thereafter is heated and fixed by a fixing device, so that a printing operation is performed.

Here, when fixing of the image on the recording material is made under a high temperature/high humidity environment water contained in the recording material is vaporized by heating, and thus condenses on a peripheral feeding path in some cases. Japanese Laid-Open Patent Application 2007-86509 discloses that the recording material is wetted when a water droplet generated by the condensation is deposited on the recording material and therefore a water-absorbing sheet member such as a nonwoven fabric is adhered to the feeding path.

However, in recent years, downsizing of the fixing device and shortening of a first print out time are required and in some cases, as a means for achieving the downsizing and the shortening, the distance from a transfer portion to a sheet discharging portion is desired so as to be shortened. As a result, a leading end portion of the recording material is subjected to heat fixing by the fixing device simultaneously with toner (image) transfer onto a trailing end portion of the recording material in some cases.

In order to downsize the fixing device, there is a need that the spatial distance between a fixing member and a fixing frame is further decreased. In such a constitution, even if the water-absorbing member is provided on the feeding path, when the water droplet deposits and grows on the fixing frame disposed in the neighborhood of the fixing member, there is a possibility that an electroconductive fixing and an electroconductive fixing frame are electrically conducted via the water droplet. The fixing frame is grounded via a main assembly frame in many cases, and therefore when sheet passing is made under the high temperature/high humidity environment, a transfer current leaks from the transfer portion along the recording material, so that a sufficient transfer current cannot be ensured at the transfer portion. As a result, there is a possibility that an image defect is generated at the transfer portion.

This will be specifically described using FIG. 8. In FIG. 8, (*a*) shows a comparison example in which an electroconductive pressing roller 32 is grounded via a grounding resistor R1 and in which a secondary transfer roller 13, an intermediary transfer belt 7, a fixing film unit 30, the pressing roller 32, a fixing frame 37, a transfer voltage source 26 and a recording material P are provided.

In the high temperature/high humidity environment, in accordance with an applied voltage, a predetermined transfer current Itr flows, but the recording material P left standing in the high temperature/high humidity environment is low in resistance and the current not only flows in a direction toward the intermediary transfer belt 7, but also partly flows through the recording material P as in the form of a run-cut current Ip. When this run-out current is excessively large, improper transfer is caused at a secondary transfer portion. Therefore, in the case where the pressing roller 32, which is an electroconductive member, is grounded, the resistor R1is provided as the grounding resistor having a high resistance to some extent ((*b*) of FIG. 8).

Here, in the case where the recording material left standing in the high temperature/high humidity environment is continuously passed through the fixing device, as shown in (*b*) of FIG. 8, water contained in the recording material becomes water vapor in a large amount, and then the water vapor is diffused and cooled to form a water droplet M. When the water droplet M deposits and grows on the fixing frame 37 and then contacts the surface of the pressing roller 32, the pressing roller 32 and the fixing frame 37 are in an electrically connected state via the water droplet M. In such a state, the grounding resistor R1 for the pressing roller 32 does not perform its function, and therefore the transfer current Ip leaks in a large amount via the recording material P, so that the improper transfer is generated.

SUMMARY OF THE INVENTION

According to an aspect of the present invention, there is provided an image forming apparatus for forming a toner image on a recording material. The apparatus comprises: an image forming portion for forming the toner image on the recording material; and a fixing portion for fixing the toner image on the recording material by feeding and heating the recording material on which the toner image is formed at a nip. The fixing portion includes a first rotatable member, a second rotatable member for forming the nip in contact with the first rotatable member, and a casing. An outer surface of the first rotatable member has electroconductivity. The casing has an opposing surface which opposes the outer surface of the first rotatable member and which has electroconductivity. In a region above a lowest point of the outer surface of the first rotatable member with respect to a direction of gravity, an insulating member is provided between the opposing surface and the outer surface of the first rotatable member.

According to another aspect of the present invention, there is provided an image forming apparatus for forming a toner image on a recording material. The apparatus comprises: an image forming portion for forming the toner image on the recording material; and a fixing portion for fixing the toner image on the recording material by feeding and heating the recording material on which the toner image is formed at a nip. The fixing portion includes a first rotatable member, a second rotatable member for forming the nip in contact with the first rotatable member, and a casing. An outer surface of the first rotatable member has electroconductivity. The casing has an opposing surface which opposes the outer surface of the first rotatable member and which has electroconductivity. An insulating member provided with a water-absorbing member is provided between the opposing surface and the outer surface of the first rotatable member.

These and other objects, features and advantages of the present invention will become more apparent upon a consideration of the following description of the preferred embodiments of the present invention taken in conjunction with the accompanying drawings.

DESCRIPTION OF THE EMBODIMENTS

Embodiments of the present invention will be described with reference to the drawings.

<First Embodiment>

(Image Forming Apparatus)

Figure 1:
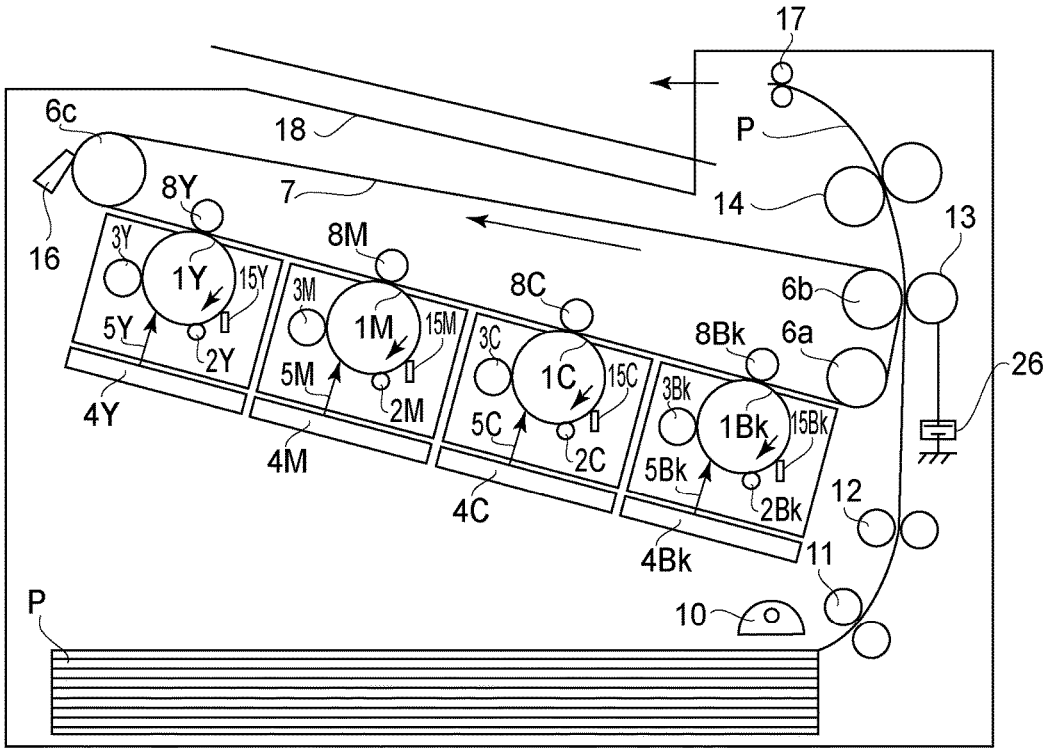
FIG. 1 is a schematic sectional view for illustrating a structure of an image forming apparatus according to First Embodiment of the present invention in which a fixing device is mounted.

An image forming apparatus A according to this embodiment includes an image forming portion including a transfer portion for transferring an unfixed image onto a recording material and a fixing portion (fixing device) for fixing the unfixed image. FIG. 1 is a schematic sectional view of the image forming apparatus A according to this embodiment as seen from a longitudinal direction. Here, the longitudinal direction refers to a direction perpendicular to a recording material feeding direction on a recording material feeding path surface. The image forming portion includes photosensitive drums 1Y, 1M, 1C, 1Bk, each having a photosensitive layer, charging rollers 2Y, 2M, 2C, 2Bk for electrically charging the photosensitive drums 1Y, 1M, 1C, 1Bk, respectively, and developing rollers 3Y, 3M, 3C, 3Bk for developing respective electrostatic latent images with toners of Y (yellow), M (magenta), C (cyan), Bk (black).

At the image forming portion, each of the photosensitive drums 1Y, 1M, 1C, 1Bk is electrically charged uniformly at a surface thereof by an associated one of the charging rollers 2Y, 2M, 2C and 2Bk while being rotated in an arrow direction. The surfaces of the photosensitive drums 1Y, 1M, 1C, 1Bk are exposed to light by laser light 5Y, 5M, 5C, 5Bk emitted from exposure devices 4Y, 4M, 4C, 4Bk, respectively, so that the latent images are formed. The latent images on the photosensitive drums 1Y, 1M, 1C, 1Bk are developed with the toners of colors of Y, M, C, Bk, respectively, by the developing rollers 3Y, 3M, 3C, 3Bk, so that developer (toner) images which are unfixed images are formed.

In an opposite side to the photosensitive drums 1Y, 1M, 1C, 1Bk, an intermediary transfer belt 7 extended and stretched around belt supporting members 6*a*, 6*b*, 6*c* is provided. Inside the intermediary transfer belt 7, primary transfer rollers 8Y, 8M, 8C, 8Bk for urging the intermediary transfer belt 7 toward the photosensitive drums 1Y, 1M, 1C, 1BK, respectively, are provided. The toner images formed on the photosensitive drums 1Y, 1M, 1C, 1Bk are primary-transferred successively onto the intermediary transfer belt 7 by the primary transfer rollers 8Y, 8M, 8C, 8Bk, respectively, to which a bias (voltage) is applied.

A recording material P stacked in a sheet feeding cassette 9 is fed by a half-moon-shaped sheet feeding roller 10 and then is separated one by one by a separation roller pair 11, and thereafter is fed to a registration roller pair 12 by which the recording material P is once stopped. In an opposite side to the belt supporting member 6*b*, a secondary transfer roller 13 as a transfer portion for transferring the toner image (unfixed image) from the intermediary transfer belt 7 onto the recording material P is provided. As the secondary transfer roller 13, a roller which is 18 mm in outer diameter and which is prepared by coating a nickel-plated steel rod of 8 mm in outer diameter with a foam sponge member, formed principally of NBR and epichlorohydrin, adjusted to have a volume resistivity of $10^8$ Ω·cm and a thickness of 5 mm.

A transfer voltage source 26 is connected with the secondary transfer roller 13, and a secondary transfer voltage outputted from a transducer (not shown) is supplied to the secondary transfer roller 13. The secondary transfer voltage is controlled at a substantially constant level by CPU (not shown) which is a control IC of the image forming apparatus in a manner such that a difference between a preset control voltage and a monitor voltage which is an actual output value. The transfer voltage source 26 is capable of outputting the voltage in a range from 100 (V) to 4000 (V).

In synchronism with the timing when the toner image formed on the intermediary transfer belt 7 reaches a secondary transfer nip formed by the secondary transfer roller 13 and the belt supporting member 6*b*, the recording material P, being at rest, is fed to the secondary transfer nip by the registration roller pair 12. Then, a secondary transfer bias is applied to the secondary transfer roller 13, so that the toner image is transferred from the intermediary transfer belt 7 onto the recording material P. The recording material P on which the toner image is transferred is separated from the intermediary transfer belt 7 and then is sent to a fixing device 14 in which the recording material P is heated and pressed, so that the toner image is melt-fixed on the surface of the recording material P. As a result, a four color-based full-color image is obtained.

Primary transfer residual toners remaining on the photosensitive drums 1Y, 1M, 1C, 1Bk without being transferred onto the intermediary transfer belt 7 during the secondary transfer are removed and collected by photosensitive drum cleaning members 15Y, 15M, 15C, 15Bk using blades. A secondary transfer residual toner remaining on the intermediary transfer belt 7 without being transferred onto the recording material P is removed and collected by an intermediary transfer belt cleaning member 16 using a blade. Then, the recording material P on which the toner image is fixed by the fixing device 14 as a fixing portion is discharged on a sheet discharge tray 18 by a sheet discharging roller pair 17, so that the image formation is ended.

In this embodiment, recording paper will be described as the recording material P, but the recording material P is not limited to paper. In general, the recording material P is a sheet-like member on which the toner image is to be formed by the image forming apparatus, and includes, for example, regular or irregular plain paper, thick paper, thin paper, an envelope, a post-card, a seal, a resin sheet, an OHP sheet, glossy paper and so on. In this embodiment, for convenience, treatment of the recording material (sheet) P will be described using terms such as sheet (paper) passing, sheet (paper) discharge, sheet (paper) feeding, a sheet (paper) passing portion, a non-sheet (paper) passing portion, but the recording material P in the present invention is not limited to the paper by such terms.

(Fixing Portion (Fixing Device))

Figure 2:
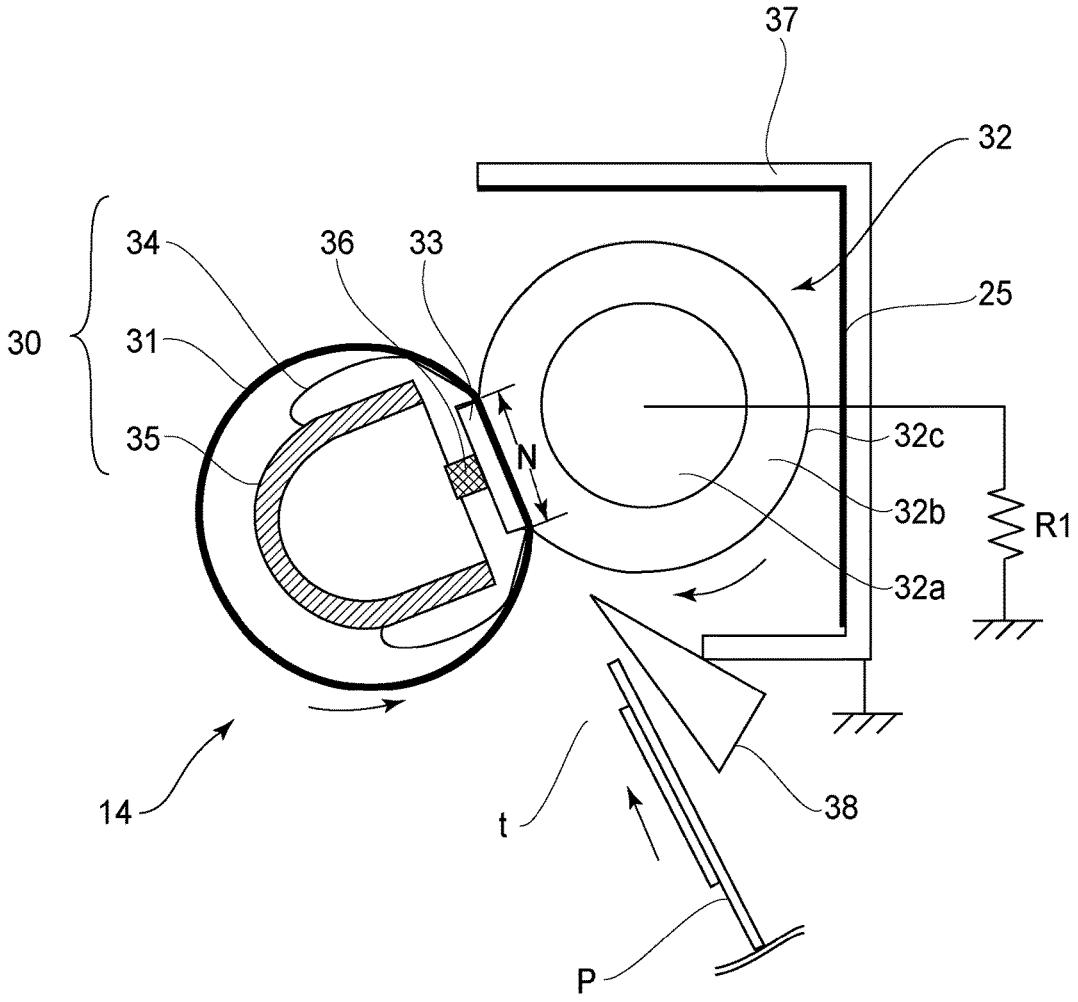
FIG. 2 is a schematic sectional view for illustrating a structure of the fixing device in First Embodiment.

In this embodiment, as an example of the fixing portion (fixing device) for fixing the unfixed image, the fixing device of a film fixing type is used. However, even when the fixing device of another type such as a heating roller type is used, for example, the present invention is applicable. FIG. 2 is a schematic sectional view of a film unit and a pressing roller portion of the fixing device 14 as seen from a longitudinal direction.

A film unit 30 includes a film (second rotatable member) 31 as a cylindrical heating member having flexibility. A pressing roller (first rotatable member) 32 as a pressing member forms a nip (fixing nip), in cooperation with the film 31 which is a rotatable member, as an opposing member opposing the film 31. The film unit 30 and the pressing roller 32 are provided so that a heater 33 opposes the pressing roller 32 via the film 31. The recording material P on which the unfixed toner image is formed at the above-described secondary transfer nip which is a transfer portion of the image forming apparatus is nipped and fed at the fixing nip, and thus is heat-fixed.

1) Pressing Roller

The pressing roller 32 includes a metal core 32*a*, an elastic layer 32*b* formed outside the metal core 32*a*, and a parting layer (surface layer) 32*c* formed outside the elastic layer 32*b*, and the surface thereof has electroconductivity. As a material for the elastic layer 32*b*, a silicone rubber, a fluorine-containing rubber or the like is used. As a material for the parting layer 32*c*, a fluorine-containing resin material such as PFA (tetrafluoroethylene-perfluoroalkylvinyl ether copolymer) or the like is used.

In this embodiment, the pressing roller 32 prepared by forming an about 3.5 mm-thick silicone rubber layer 32*b* on the metal core 32*a* formed of stainless steel in an outer diameter of 11 mm by injection molding and then by coating an about 40 μm-thick PFA resin tube 32*c* outside the silicone rubber layer 32*b* was used. This pressing roller 32 in this embodiment is 18 mm in outer diameter. A hardness of the pressing roller 32 may desirably be in a range of 40° to 70° as measured by an Asker-C hardness meter under a load of 9.8 N from the viewpoints of ensuring of the fixing nip N and durability. In this embodiment, the hardness is 54°.

The pressing roller 32 is rotatably supported at each of longitudinal end portions of the metal core 32*a* via a bearing member. The pressing roller 32 includes the metal core 32*a*, the silicone rubber layer 32*b* as a rubber (elastic) layer, and the PFA resin tube 32*c* as the parting layer. In the PFA resin tube 32*c*, an electroconductive carbon filler is added, so that the actual resistance between the metal core and the surface layer which are constituted as the roller is about 10 kΩ. Further, in order to suppress a run-out current Ip of a transfer current $I_{tr}$, also in this embodiment, the pressing roller is grounded via a resistor R1 of 1 GΩ as a grounding resistor for the pressing roller 32. The rubber layer 32*b* of the pressing roller 32 is 226 mm in longitudinal width. The filler added in the silicone rubber layer 32*b* is not limited to the carbon filler if the filler is an electroconductive filler.

2) Film Unit

The film unit 30 includes a film 31, a plate-like heater 33 contacting an inner surface of the film 31, a supporting member 34 for supporting the heater 33, and a pressing stay 35 for reinforcing the supporting member 34.

The film 31 in this embodiment is a cylindrical flexible member including a base layer, an elastic layer formed outside the base layer and a parting layer formed outside the elastic layer. The film 31 in this embodiment is 18 mm in inner diameter, and as the base layer, a 60 μm-thick polyimide base material is used. As the elastic layer, an about 150 μm-thick silicone rubber layer is used, and as the parting layer, a 15 μm-thick PFA resin tube is used. The supporting member 34 is a member having rigidity, heat-resistant property and heat-insulating property, and is formed of a liquid crystal polymer. The supporting member 34 has the function of supporting the inner surface of the film 31 externally fitted around the supporting member 34 and the function of supporting one surface of the heater 33.

The heater 33 is formed by coating an alumina substrate with a heat-generating resistor of silver-palladium alloy by screen printing or the like and then by connecting the heat-generating resistor with an electric contact portion of silver or the like. On the heat-generating resistor, a glass coat as a protective layer is formed to protect the heat-generating resistor, so that its sliding property with the film 31 is improved. The alumina substrate of the heater 33 in this embodiment is 5.8 mm in length with respect to a recording material feeding direction and 1.0 mm in thickness. On the inner surface of the film 41, 3 grease having the heat-resistant property is applied, so that the sliding property of the film 31 is improved. On the back surface of the heater 33, a thermistor 36 is mounted.

The pressing stay 35 has a U-shape in cross section in order to enhance flexural rigidity of the film unit 30, and is formed by bending a 1.6 mm-thick stainless steel plate. The heater 33 is pressed against film 31 toward the pressing roller 32 by the pressing stay 35 and the supporting member 34, so that the fixing nip N of about 6.2 mm in width is formed. In this embodiment, the pressure between the film 31 and the pressing roller 32 is 180 N in total pressure.

During an operation of the fixing device 14, a rotational force is transmitted from an unshown driving source to a driving gear of the pressing roller 32, so that the pressing roller 32 is rotationally driven in the clockwise direction in FIG. 1 at a predetermined speed. As a result, as shown in FIG. 1, the film 31 is rotated in the counterclockwise direction by the rotation of the pressing roller 32 while sliding on a surface of the heater 33.

The film 31 is rotated and energization to the heater 33 is made, and in a state in which a detection temperature of the thermistor 36 reaches a target temperature, the sheet P is carried is introduced into the fixing nip N along an entrance guide 38. Then, the surface of the recording material P on which a toner image t is carried is closely contacted to the film 31 is nipped and fed together with the film 31 through the fixing nip N. In this feeding process, the toner image t on the recording material P is heated and pressed on the recording material P, and is fixed. The recording material P passed through the fixing nip N is curvature-separated from the surface of the film 31 and then is discharged by the sheet discharging roller pair 17.

3) Distance from Transfer Portion to Fixing Nip (Nip)

In this embodiment, the distance from the transfer portion to the fixing nip (nip) N is 50 mm. For that reason, when the recording material P having an ordinary A4 size or letter size is passed through the fixing nip N, at a trailing end portion of the recording material P, the toner image t is transferred onto the recording material P by the secondary transfer roller 13 as the transfer portion for transferring the toner image, and at the same time, at a leading end side of the recording material P, the toner image t is fixed by the fixing device 14. That is, a recording material longer than a length with respect to the recording material feeding direction between a position of the transfer portion where the unfixed image is transferred and a position of the nip (fixing nip N) exists.

(Insulating Member)

Figure 3:
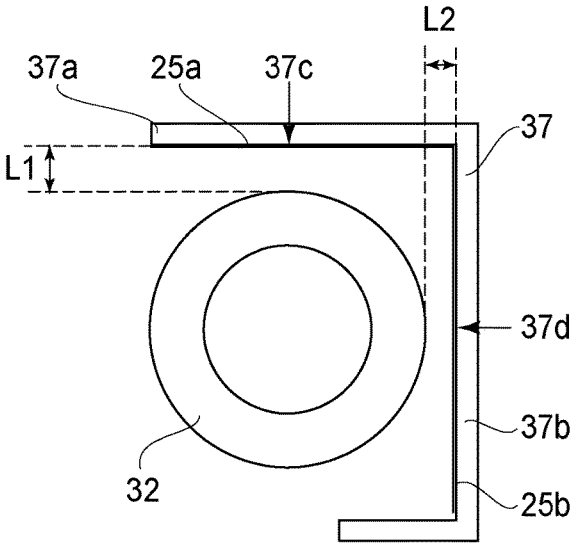
In FIG. 3, (*a*) and (*b*) are schematic views for illustrating a mounting region of an insulating member in First Embodiment.
Figure 3:
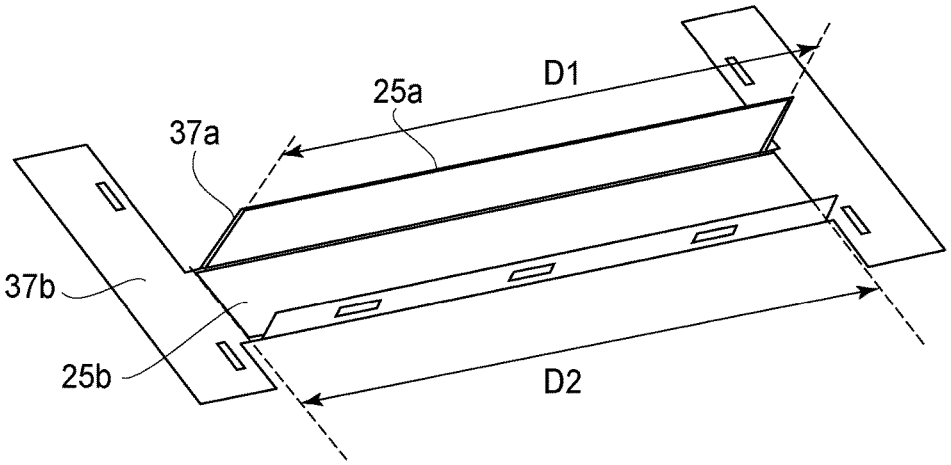

In FIG. 3, (*a*) is a schematic view of a fixing frame 37 of the fixing device 14 shown in FIG. 2. In FIG. 3, (*b*) is a perspective view of the fixing frame 37. An arrangement constitution of an insulating member 25 which is the feature of the present invention will be described using FIGS. 2 and 3. The insulating member 25 in this embodiment is provided between the surface of the pressing roller 32 and the fixing frame 37 so as not to establish electrical connection between the electroconductive surface of the pressing roller (first rotatable member) 32 and the fixing frame 37, which is an electroconductive casing.

In this embodiment, as the fixing frame 37, a 0.6 mm-thick zinc-coated steel plate is used, so that the electroconductive casing is provided. The insulating member 25 in this embodiment is formed with a 0.2 mm-thick sheet (film) of a polycarbonate recording material having a heat-resistant property, and is bonded to the fixing frame 37 using a double-side tape. In this embodiment, a minimum distance L1 ((*a*) of FIG. 3) from the surface of the pressing roller 32 to an upper-surface fixing frame 37*a* is 3.0 mm, and a minimum distance L2 ((*a*) of FIG. 3) from the surface of the pressing roller 32 to a rear-surface fixing frame 37*b* is 2.0 mm.

As a result, the gap (spacing) between the electroconductive pressing roller 32 and the insulating member 25 is shorter than the distance from a deposited surface of a largest water droplet, capable of depositing on the fixing frame 37 opposing the pressing roller 32, to the pressing roller 32.

The position (region) where the insulating member 25 is disposed may desirably be broader than a maximum sheet passable width of 216 mm of the recording material P as a water droplet generating source, and is further desirably broader than a rubber layer width of 226 mm of the pressing roller 32. In this embodiment, the longitudinal width D1 ((*b*) of FIG. 3) of an upper surface 25*a* of the insulating member 25 is 232 mm, and the longitudinal width D2 ((*b*) of FIG. 3) of a rear surface 25*b* is 236 mm. As for a position of the insulating member 25 with respect to a longitudinal cross-sectional direction, the insulating member 25 may desirably be provided so as to include an upper-surface point 37*c* ((*a*) of FIG. 3) and a rear-surface point 37*d* ((*a*) of FIG. 3).

Further, as for a width of the insulating member 25, the width may desirably be broader than such the width that a bottom of the maximum water droplet capable of depositing on the insulating member 25 falls within the insulating member 25 even when the water droplet is contacted to the pressing roller 32. That is, a size of a region of the insulating member 25 may desirably be larger than a deposited region of the water droplet at the position of the insulating member 25 in the case where the maximum (largest) water droplet capable of depositing on the insulating member 25 is contacted to the surface of the electroconductive pressing roller 32.

In this embodiment, as for the width with respect to the longitudinal cross-sectional direction, the insulating member 25 is bonded to a substantially entire surface of the fixing frame 37. That is, the size of the region of the insulating member 25 is equal to a size of a region of the fixing frame 37 which is the electroconductive casing opposing the surface of the electroconductive pressing roller 32.

(Action (Function) of Insulating Member)

In this embodiment, insulation by the insulating member 25 is made between the electroconductive pressing roller 32 and the electroconductive fixing frame 37, and therefore even when the deposition of the water droplet occurs, it is possible to reduce a degree of the possibility that the secondary transfer current leaks.

Figure 4:
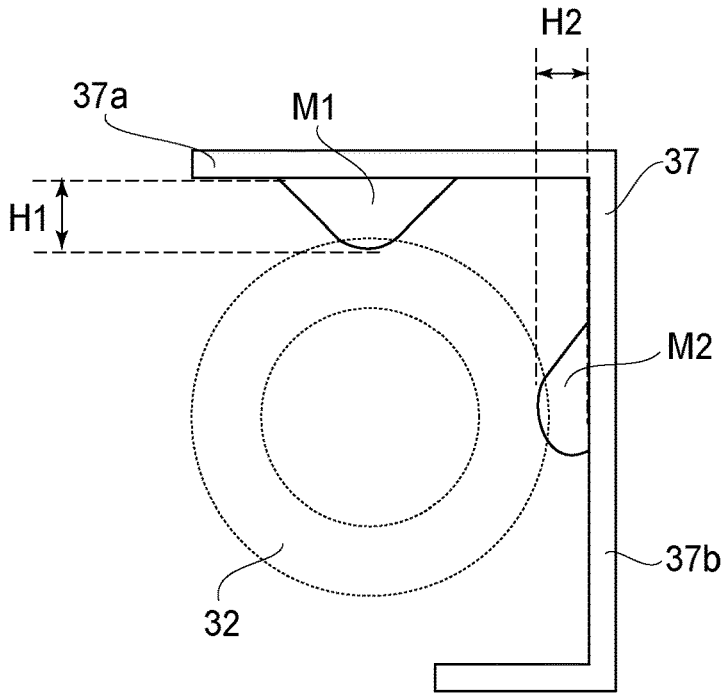
FIG. 4 is a schematic view for illustrating a size of a water droplet capable of being deposited on a fixing frame.

FIG. 4 is a schematic view for illustrating the action (function) of the insulating member 25 in this embodiment. FIG. 4 is a cross-sectional view of the fixing frame 37 alone in the case where the insulating member 25 is not bonded to the fixing frame 37. In FIG. 4, a position where the pressing roller 32 is to be originally mounted is represented by dotted lines. On the fixing frame 37 used in this embodiment, a water droplet M1 capable of depositing on the fixing frame upper surface 37*a* has a maximum height H1 of about 3.5 mm, and maximum widths I1 and I2 from a peak to a bottom of the water droplet M1 are about 5 mm.

A water droplet M2 capable of depositing on the fixing frame rear surface 37*b* has a maximum height H2 of about 2.5 mm, a maximum width I3 from a peak to a bottom of the water droplet M2 is about 5 mm, and a maximum width I4 from a peak to a bottom of the water droplet M2 is about 1.5 mm. The water droplets M is in a dropping shape by gravitation, and therefore the maximum height thereof also varies depending on a position where the water droplets M are deposited. When the water droplets M become further large, the water droplets M naturally drop by gravitation.

As described above, the minimum distance L1 from the surface of the pressing roller 32 to the upper-surface fixing frame 37*a* is 3.0 mm, and the minimum distance L2 from the surface of the pressing roller 32 to the rear-surface fixing frame 37*b* is 2.0 mm. The maximum heights of the water droplets M capable of depositing on the fixing frame 37 are larger than the associated distance between the surface 32 and the fixing frame upper-surface 37*a* or the rear-surface fixing frame 37*b*. For that reason, depending on a deposited position of the water droplets M, the water droplets M grow and contact the pressing roller 32, so that an electrical conduction path from the pressing roller 32 to the fixing frame 37 is formed and thus a transfer current leaks through the recording material.

On the other hand, in this embodiment, the insulating member 25 is bonded to the upper surface 37*a* and the rear surface 37*b* of the fixing frame 37. For that reason, even if the water droplet grows on the surface of the insulating member 25 and contacts the surface of the pressing roller 32, the surface of the pressing roller 32 and the upper surface 37*a* of the fixing frame 37 are not electrically conducted to each other. The upper surface 37*a* of the fixing frame 37 extends in the horizontal direction at a position above an uppermost point of the pressing roller 32 with respect to the direction of gravity. The rear surface 37*b* of the fixing frame 37 extends from a position below a lowest point of the pressing roller 32 toward a position above the uppermost point of the pressing roller 32 with respect to the direction of gravity.

Figure 5:
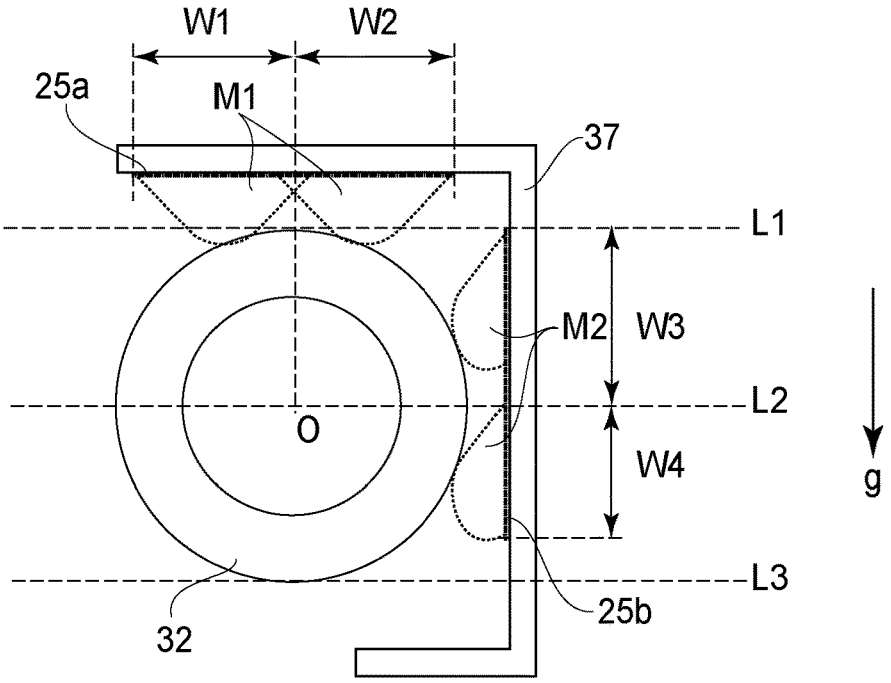
FIGS. 5, 6 and 7 are schematic views for illustrating functional effects of insulating members in a First Embodiment, a Second Embodiment and a Third Embodiment, respectively.

Here, of an opposing surface of the fixing frame 37 opposing the surface of the pressing roller 32, a position (region) where the insulating member 25 may desirably be provided will be described using FIG. 5. In FIG. 5, an arrow g represents the direction of gravity. In FIG. 5, L1 represents a horizontal line passing through the uppermost point of the pressing roller 32, L2 represents a horizontal line passing through a rotation center O of the pressing roller 32, and L3 represents a horizontal line passing through the lowest point of the pressing roller 32.

The region of the fixing frame 37 is, for convenience, divided into four regions consisting of a region (first region) above L1, a region (second region) below L1 and above L2, a region (third region) below L2 and above L3, and a region (fourth region) below L3, with respect to the direction of gravity. In the constitution in this embodiment, a region where the maximum height of the water droplet is liable to become high under the influence of gravitation, i.e., a possibility that the electrical conduction path is formed between the surface of the pressing roller 32 and the fixing frame 37 is highest, is the first region. Further, when the distance between the surface of the pressing roller 32 and the fixing frame 37 in the constitution in FIG. 5 is taken into consideration, the possibility of formation of the electrical conduction path is higher in the third region than in the second region. Further, in the fourth region, the height of the water droplet becomes low by gravitation, and therefore the electrical conduction path is not readily formed.

In the constitution in this embodiment shown in FIG. 5, insulating members (25*a*, 25*b*) are provided in the regions (first region, second region, third region) above L3, but are not provided in the region below L3.

Incidentally, as shown in FIG. 3, the insulating member 25 may also be provided in the region below L3.

Next, using FIG. 5, an area of the insulating member 25 will be considered. In FIG. 5, widths W1, W2, W3, W4 are widths substantially equivalent to positions of bottoms of water droplets in the case where maximum water droplets capable of depositing on the insulating member 25 contacts the surface of the pressing roller 32.

On the insulating member 25 used in this embodiment, the maximum height H1 of the water droplets M1 capable of depositing on the upper surface 37*a* is about 3.2 mm, and the maximum widths I1 and I2 from the peak to the bottom of the water droplet M1 are about 5 mm. The maximum height H2 of the water droplets M2 capable of depositing on the rear surface 37*b* of the insulating member 25 is about 2.5 mm, and the Maximum widths I3 and I4 from the peak to the bottom of the water droplet M2 are about 4.5 mm and about 1.5 mm, respectively. The shapes of the water droplets are determined principally by surface tension between the insulating member and the water droplet, interfacial tension between the insulating member and the water droplet and the direction of gravity g.

Even when these water droplets M1, M2 capable of depositing the fixing frame 37 contact the pressing roller 32, in order to prevent the pressing roller 32 and the fixing frame 37 from being electrically connected with each other via the water droplets M1, M2, a result of study made by the present inventors was as follows. That is, in (*a*) of FIG. 5, the width of the upper-surface insulating member 25*a* was W1=W2=9.0 mm or more, and the width of the rear-surface insulating member 25*b* was W3=8.5 mm or more and W4=6.5 mm or more.

However, in a preferred embodiments, each of the widths W1, W2, W3, W4 is extended in the widthwise direction by about 5 mm. In this embodiment, the insulating member is bonded on the fixing frame 37 at the entire surface of the upper-surface fixing frame 37*a* and at the entire surface of the rear-surface fixing frame 37*b* while leaving a region of 1 mm from the lower end of the rear-surface fixing frame 37*b*. Specifically, w1=9.0 mm, W2=11.0 mm, W3=12.0 mm, and W4=11.0 mm.

As described above, by setting the positions and the areas (sizes) in which the insulating member 25 is disposed, it is further reduce a degree of the possibility that the surface of the pressing roller 32 and the fixing frame 37 are electrically connected with each other via the water droplet.

In this embodiment, the sheet-like insulating member was used as the insulating member, but such an insulating member that the shape thereof is changed by providing the surface thereof with projections and recesses or the like may also be used as the insulating member.

<Second Embodiment>

In this embodiment, in place of the polycarbonate resin material used in First Embodiment, a PTFE (polytetrafluoroethylene) type which is a tape of fluorine-containing resin material is used as the insulating member. A difference between this embodiment and First Embodiment is only the material for the insulating member 25, and other constitutions of the image forming apparatus and the fixing device are similar to those in First Embodiment, and therefore will be omitted from description.

Figure 6:
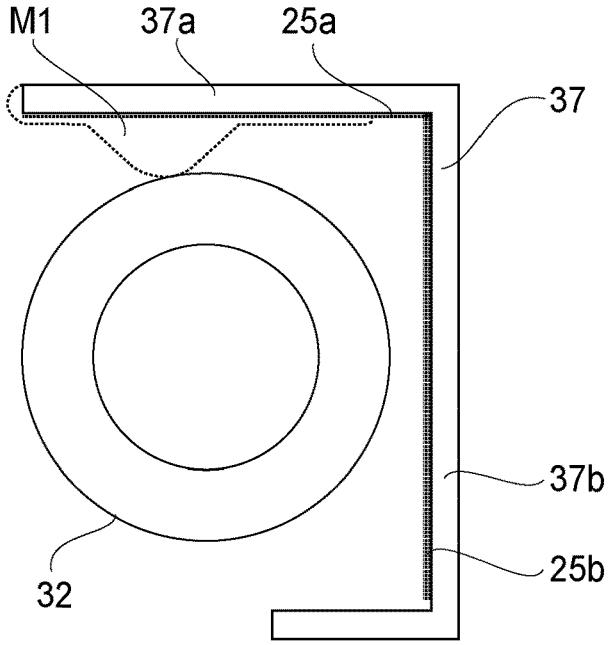
Figure 6:
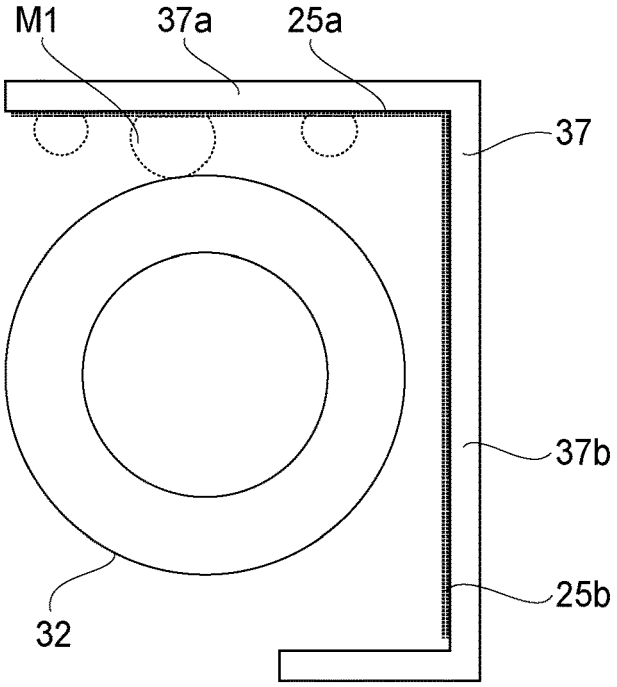

The feature of this embodiment will be described based on FIG. 6. In this embodiment, as the insulating member, a 0.1 mm-thick PTFE tape is used. In this embodiment, a pure water contact angle (contact angle for pure water) of the insulating member is larger than that of the polycarbonate resin material used in First Embodiment. Specifically, the insulating member used in First Embodiment is about 75° in pure water contact angle, whereas the insulating member used in this embodiment is not less than 90° (specifically about 105°) in pure water contact angle.

As for the insulating member in First Embodiment, it is possible to prevent short circuit between the pressing roller and the fixing frame by a single water droplet. However, as shown in (*b*) of FIG. 6, a possibility that the electrical connection between the pressing roller and the fixing frame is formed by such a phenomenon that the water droplets deposited on the insulating member are left in a slight amount and are connected with the water droplet contacting the pressing roller is left.

In this embodiment, by using a fluorine-containing resin material having such a high water-repellent property that the pure water contact angle exceeds 90°, the water droplet is easily dropped, and therefore the maximum height of the water droplet capable of depositing on the insulating member becomes small. Further, the water droplet left on the insulating member can be isolated by the surface tension thereof, and therefore by connection of the water droplets with each other, it is possible to further reduce the degree of the possibility that the electrical connection between the pressing roller and the insulating member is established.

As described above, in this embodiment, the material having a higher water-repellent property is used as the material for the insulating member, so that it is possible to reduce a degree of a possibility that improper transfer generates. In this embodiment, the PTFE tape is used as the insulating member, but such an insulating member that the insulating member used in First Embodiment is subjected to coating with a fluorine-containing resin material may also be used as the insulating member.

<Third Embodiment>

In this embodiment, an insulating member obtained by bonding a nonwoven fabric as a water-absorbing member to the insulating member used in First Embodiment is used as the insulating member. A difference between this embodiment and First Embodiment is only the width of the insulating member 25 and a nonwoven fabric 27, and other constitutions of the image forming apparatus and the fixing device are similar to those in First Embodiment, and therefore will be omitted from description.

Figure 7:
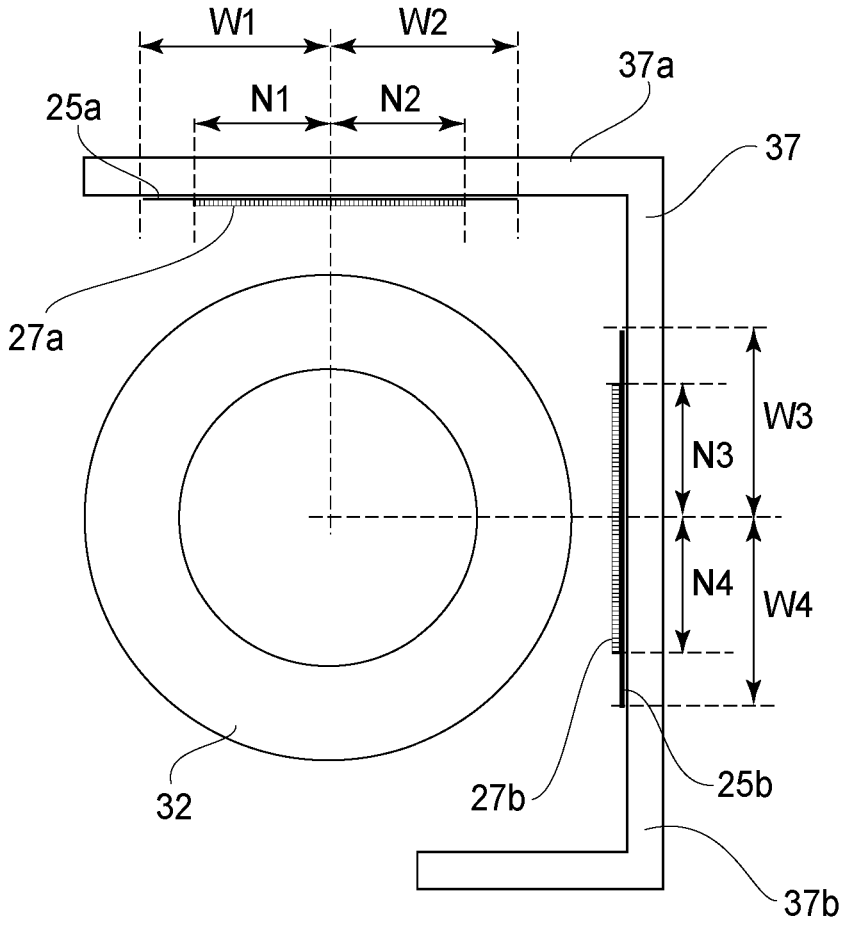
Figure 8:
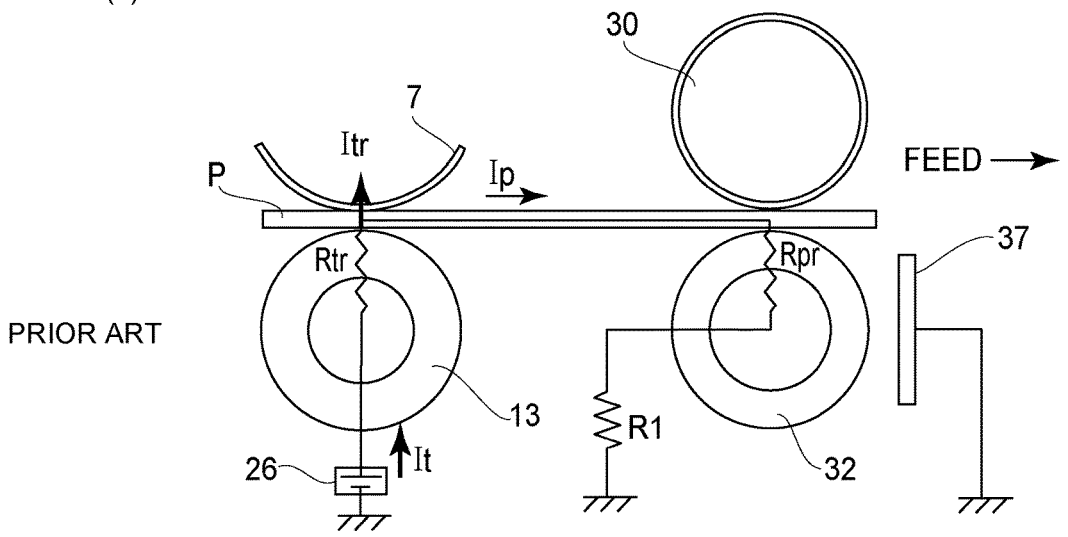
In FIG. 8, (*a*) and (*b*) are schematic views for illustrating a conventional fixing device.
Figure 8:
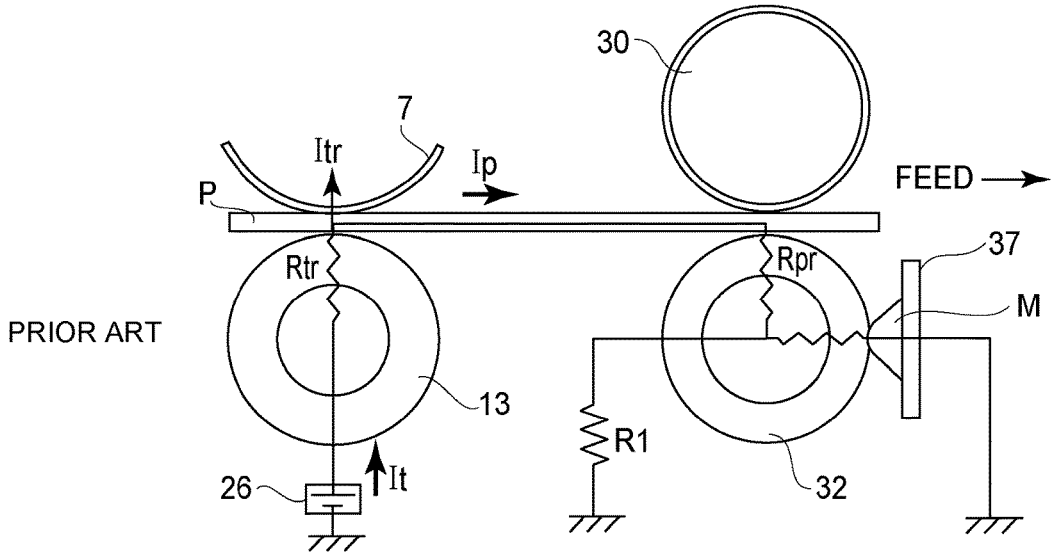

The feature of this embodiment will be described based on FIG. 7. In this embodiment, as the insulating member 25, the 0.2 mm-thick polycarbonate resin material used in First Embodiment is used. In this embodiment, on the insulating member 25, as the nonwoven fabric 27, a 0.25 mm-thick nonwoven fabric ("Himeron" (registered trademark), manufactured by Ambic Co., Ltd.) is bonded using a double-side tape.

In this embodiment, the nonwoven fabric 27 is provided on the insulating member 25, so that a water droplet-absorbing effect is achieved, and therefore the water droplet does not readily grow largely on the insulating member 25. That is, the height and the width of the maximum water droplet capable of depositing on the insulating member 25 become small, and therefore the width of the insulating sheet can be made small. In this embodiment, the width of the insulating member 25 is W1=W2=W3=W4=7.0 mm, the width of the nonwoven fabric 27 is N1=N2=N3=N4=5.0 mm.

Incidentally, the full width of the insulating member 25 with respect to the longitudinal direction is similar to that in First Embodiment, and the full width of the nonwoven fabric 27 is such that the longitudinal width of the insulating member upper surface 25*a* is 228 mm and the longitudinal width of the insulating member rear surface 25*b* is 232 mm. The reason why the area of the nonwoven fabric 27 is smaller than the area of the insulating member 25 is that although the nonwoven fabric 27 itself is originally insulative, the nonwoven fabric 27 is capable of absorbing water to have electroconductivity and therefore there is a need to dispose the nonwoven fabric 27 within a region of the insulating member 25 including a bonding tolerance.

As described above, by bonding the nonwoven fabric 27 onto the insulating member 25, the area of the insulating member 25 can be made small while reducing a degree of a liability that the transfer current leaks due to the water droplet. Particularly, the constitution in this embodiment is effective in the case where there is a constraint of the region where the insulating member is capable of being bonded onto the fixing frame.

(Modified Embodiments)

Preferred embodiments of the present invention are described above, but the present invention is not limited thereto and can be variously modified and changed within the scope thereof.

(Modified Embodiment 1)

In the above-described embodiments, the constitution in which the pressing roller as the first rotatable member has the electroconductivity and the electroconductive casing is provided opposed to the pressing roller and between the electroconductive pressing roller and the electroconductive casing, the insulating member is provided was described, but the present invention is not limited thereto. A constitution in which a film as the first rotatable member has the electroconductivity and the electroconductive casing is provided opposed to the pressing roller and between the electroconductive film and the electroconductive casing, the insulating member is provided may also be employed.

Further, a constitution in which both of the first and second rotatable members forming the nip are electroconductive and are opposed to the electroconductive casing and the insulating member is provided between the electroconductive first rotatable member and the electroconductive casing and between the electroconductive second rotatable member and the electroconductive casing may also be employed.

(Modified Embodiment 2)

In the above-described embodiments, the case where the pressing roller as the pressing member presses the film as the rotatable member was described, but the present invention is not limited thereto. The present invention is similarly applicable to the case where the film is pressed by a film as an opposing member, not the pressing member.

(Modified Embodiment 3)

In the above-described embodiments, the case where the film as the heating member is heated by the heater was described, but the present invention is not limited thereto. The film may also be heated by a halogen lamp, electromagnetic induction heating, energization to the film, and so on.

(Modified Embodiment 4)

In the above-described embodiments, the fixing device for fixing the unfixed toner image on the sheet was described as an example, but the present invention is not limited thereto. The present invention is similarly applicable to a device for heating and pressing the toner image fixed temporarily on the sheet in order to improve a glossiness of an image (also in this case, the device is referred to as the fixing device).

Further, the image forming apparatus according to the present invention is not limited to an image forming apparatus in which the fixing device and the fixing portion is fixedly provided, but may also be an image forming apparatus from which the fixing device prepared as a unit is exchangeable and demountable to the outside of the image forming apparatus.

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-230495 filed on Nov. 13, 2014, which is hereby incorporated by reference herein in its entirety.

What is claimed is:

1. An image forming apparatus for forming a toner image on a recording material, the image forming apparatus comprising:

(A) an image forming portion configured to form the toner image on the recording material; and (B) a fixing portion configured to fix, at a nip, the toner image on the recording material by feeding and heating the recording material on which the toner image is formed, the fixing portion including:

(a) a roller having an outer surface that has electroconductivity, (b) a rotatable member that forms the nip and is in contact with the roller, and (c) a casing having electroconductivity, wherein, in a region above a horizontal virtual line passing through a rotation center of the roller in a cross section of the fixing portion orthogonal to a rotational axis direction of the roller, an electrical insulating member is provided on an inner surface of the casing, so that the electrical insulating member is positioned (i) nearest to the outer surface of the roller, and (ii) between the inner surface of the casing and the outer surface of the roller, such that the electrical insulating member does not directly or indirectly contact the outer surface of the roller, and the electrical insulating member is provided with a water-absorbing member.

2. The image forming apparatus according to claim 1, wherein, when the recording material, on which the toner image is formed, is fed at the nip, the toner image contacts the rotatable member.

3. The image forming apparatus according to claim 2, wherein the rotatable member is a cylindrical film.

4. The image forming apparatus according to claim 1, wherein the electrical insulating member is formed of a polycarbonate resin material.

5. The image forming apparatus according to claim 1, wherein the electrical insulating member is formed of a fluorine-containing resin material.

6. The image forming apparatus according to claim 1, wherein the roller includes a surface layer formed of a resin material in which an electroconductive filler is added.

7. The image forming apparatus according to claim 6, wherein the roller includes a metal core and an elastic layer that surrounds the metal core.

8. The image forming apparatus according to claim 7, wherein a length of the electrical insulating member is longer than a length of the elastic layer of the roller in the rotational axis direction of the roller.

9. The image forming apparatus according to claim 1, wherein the water-absorbing member is a nonwoven fabric.

10. The image forming apparatus according to claim 1, wherein the electrical insulating member is a sheet-like member.

11. An image forming apparatus for forming a toner image on a recording material, the image forming apparatus comprising:

an image forming portion configured to form the toner image on the recording material; and a fixing portion configured to fix, at a nip, the toner image on the recording material by feeding and heating the recording material on which the toner image is formed, the fixing portion including a first rotatable member, a second rotatable member that forms the nip and is in contact with the first rotatable member, and a casing, wherein an outer surface of the first rotatable member has electroconductivity, wherein the casing has an opposing surface which opposes the outer surface of the first rotatable member and which has electroconductivity, and wherein an insulating member provided with a water-absorbing member is provided between the opposing surface of the casing and the outer surface of the first rotatable member.

12. The image forming apparatus according to claim 11, wherein, when the recording material, on which the toner image is formed, is fed at the nip, the toner image contacts the second rotatable member.

13. The image forming apparatus according to claim 11, wherein the insulating member is formed of a polycarbonate resin material.

14. The image forming apparatus according to claim 11, wherein the insulating member is formed of a fluorine-containing resin material.

15. The image forming apparatus according to claim 11, wherein the first rotatable member includes a surface layer formed of a resin material in which an electroconductive filler is added.

16. The image forming apparatus according to claim 15, wherein the first rotatable member is a roller including a metal core.

17. The image forming apparatus according to claim 11, wherein the second rotatable member is a cylindrical film.

18. The image forming apparatus according to claim 11, wherein the water-absorbing member is a nonwoven fabric.

* * * * *